US009450303B2

(12) United States Patent
Su et al.

(10) Patent No.: US 9,450,303 B2
(45) Date of Patent: Sep. 20, 2016

(54) ANTENNA STRUCTURE

(71) Applicant: INPAQ TECHNOLOGY CO., LTD., Miaoli County (TW)

(72) Inventors: Chih-Ming Su, Taipei (TW); En-Zo Yu, Taichung (TW); Ci-Jie Huang, Hsinchu (TW); Chung-Che Yang, Taichung (TW)

(73) Assignee: INPAQ TECHNOLOGY CO., LTD., Miaoli County (TW)

( * ) Notice: Subject to any disclaimer, the term of this patent is extended or adjusted under 35 U.S.C. 154(b) by 226 days.

(21) Appl. No.: 14/082,238

(22) Filed: Nov. 18, 2013

(65) Prior Publication Data

US 2015/0138034 A1 May 21, 2015

(51) Int. Cl.
*H01Q 7/00* (2006.01)
*H01Q 1/52* (2006.01)
*H01Q 1/38* (2006.01)

(52) U.S. Cl.
CPC ..... *H01Q 1/526* (2013.01); *H01Q 1/38* (2013.01); *H01Q 7/00* (2013.01)

(58) Field of Classification Search
CPC ..... H01Q 7/00; H01Q 1/38
USPC ..... 343/788, 842, 866, 867, 741, 742
See application file for complete search history.

(56) References Cited

U.S. PATENT DOCUMENTS 5,574,470 A * 11/1996 de Vall ..... G06K 7/10336 340/572.7
7,764,236 B2 * 7/2010 Hill ..... H01Q 1/243 343/702
2005/0134519 A1 * 6/2005 Fukano ..... G06K 7/10336 343/867

* cited by examiner

*Primary Examiner* — Dameon E Levi
*Assistant Examiner* — Hasan Islam
(74) *Attorney, Agent, or Firm* — Li & Cai Intellectual Property (USA) Office

(57) ABSTRACT

An antenna structure includes a radiation module and a metal board. The radiation module has a first coil unit and a second coil unit. The first coil unit is coupled to the second coil unit. The first coil unit and the second coil unit have opposite direction of current. The metal board is disposed at one side of the radiation module. The metal board has an enclosed slot which has a first slot portion and a second slot portion.

8 Claims, 14 Drawing Sheets

ANTENNA STRUCTURE

BACKGROUND OF THE INVENTION

1. Field of the Invention

The present disclosure relates to an antenna structure; in particular, to an antenna structure which has two coupled coils and is used in back covers of cell phones.

2. Description of Related Art

With the advancement of wireless communication technology, the user can freely use wireless communication systems to transfer data. Portable electronic devices using wireless communication technology such as notebook computers, cell phones, personal digital assistants (PDA), and smart phones are increasingly widespread and diverse, and the antenna for receiving electromagnetic signals are important components of wireless communication devices.

Radio frequency identification (RFID) is a communication technology using electromagnetic signals to identify specific tags and read and store data. The operating principle of radio frequency identification uses an antenna of an external RFID reader to emit electromagnetic waves to trigger a radio frequency identification tag (such as a non-contact IC card) within a sensing range. The radio frequency identification tag responds to the magnetic field by creating an electric current in the radio frequency identification chip, which in turn emits electromagnetic waves to be read by the reader, thereby achieving the purpose of infrared frequency identification. However, raising sensing range and data transmission quality has always been an important issue for the major manufacturers. Hence, through devoted research combined with application of theory, the present inventor proposes the present disclosure which has a reasonable design and effectively improves upon the above mentioned disadvantages.

SUMMARY OF THE INVENTION

The object of the present disclosure is to provide an antenna structure which has two coupled coils and an enclosed slot of a metal board for increasing the sensing range and data transmission quality.

In order to achieve the aforementioned objects, the present disclosure provides an antenna structure including: a radiation module and a metal board. The radiation module has a first coil unit and a second coil unit coupled to each other. The current in the first coil unit and the current in the second coil unit flow in opposite directions. The metal board is disposed at one side of the radiation module and has an enclosed slot. The enclosed slot has a first slot portion and a second slot portion. Specifically, the antenna structure can further include an insulation carrier board having a first surface and a second surface opposite each other. The first coil unit and the second coil unit are disposed on the first surface. The metal board is disposed on top of the first surface. The winding center of the first coil unit has a first coil opening, and the winding center of the second coil unit has a second coil opening. When the metal board is disposed on top of the first surface of the carrier board, at least a portion of the first coil opening is exposed at the metal board by the first slot portion of the metal board, and at least a portion of the second coil opening is exposed at the metal board by the second slot portion of the metal board. Preferably, the radiation module further includes a connection unit, two ends of which are respectively connected to the first coil unit and the second coil unit. When the metal board is disposed on top of the first surface of the carrier board, the metal board shields the first coil unit and the second coil unit, and the connection unit is exposed at the metal board by the enclosed slot of the metal board.

The first coil unit and the second coil unit of the antenna structure of the present disclosure are coupled, and the first coil opening of the first coil unit and the second coil opening of the second coil unit are exposed at the metal board by the enclosed slot of the metal board, effectively increasing the effective sensing range and data transmission quality.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
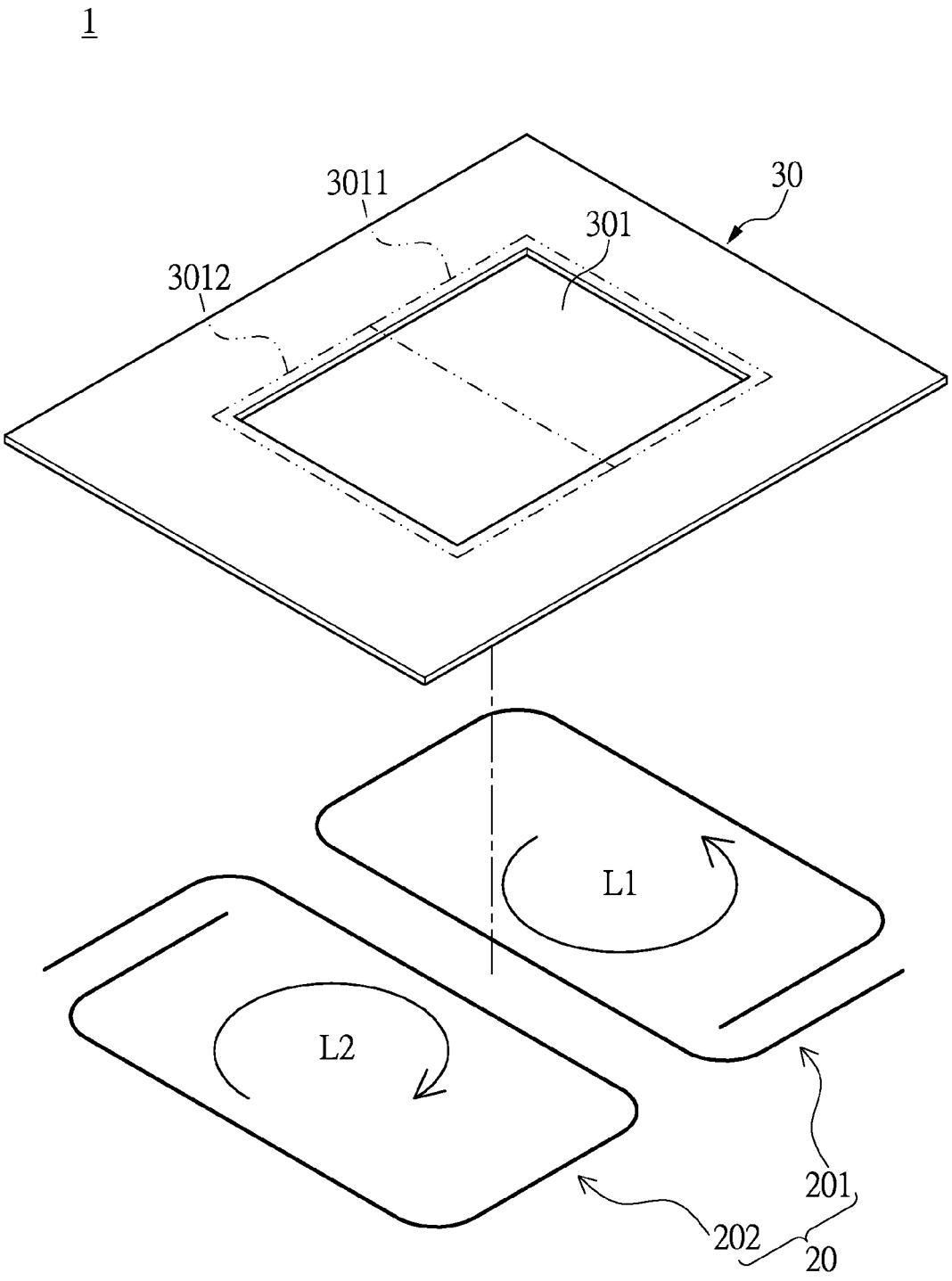
FIG. 1 shows a schematic diagram of an antenna structure according to the present disclosure.

FIG. 1 shows a schematic diagram of an antenna structure according to the present disclosure. As shown in the figure, the antenna structure 1 includes: a radiation module 20 and a metal board 30. The radiation module 20 has a first coil unit 201 and a second coil unit 202 coupled to each other. The electric current of the first coil unit 201 and the electric current of the second coil unit 202 flow in opposite directions (e.g. the electric current in the first coil unit 201 flows in a clockwise direction and the electric current in the second coil unit 202 flows in a counter-clockwise direction, or vice versa). The metal board 30 is disposed at one side of the radiation module 20. The metal board 30 has an enclosed slot 301. The enclosed slot 301 has a first slot portion 3011 and a second slot portion 3012. In practice, the metal board 30 is disposed at one side of the radiation module 20, and from a top view, the metal board 30 shields most of the first coil unit 201 and the second coil unit 202, and the first slot portion 3011 and the second slot portion 3012 of the metal board 30 respectively expose the first coil unit 201 and the second coil unit 202. The first coil unit 201 and the second coil unit 202 can be made of gold, silver, palladium, platinum, tungsten, copper, an alloy or a composition of these metals.

[First Embodiment]

Figure 2:
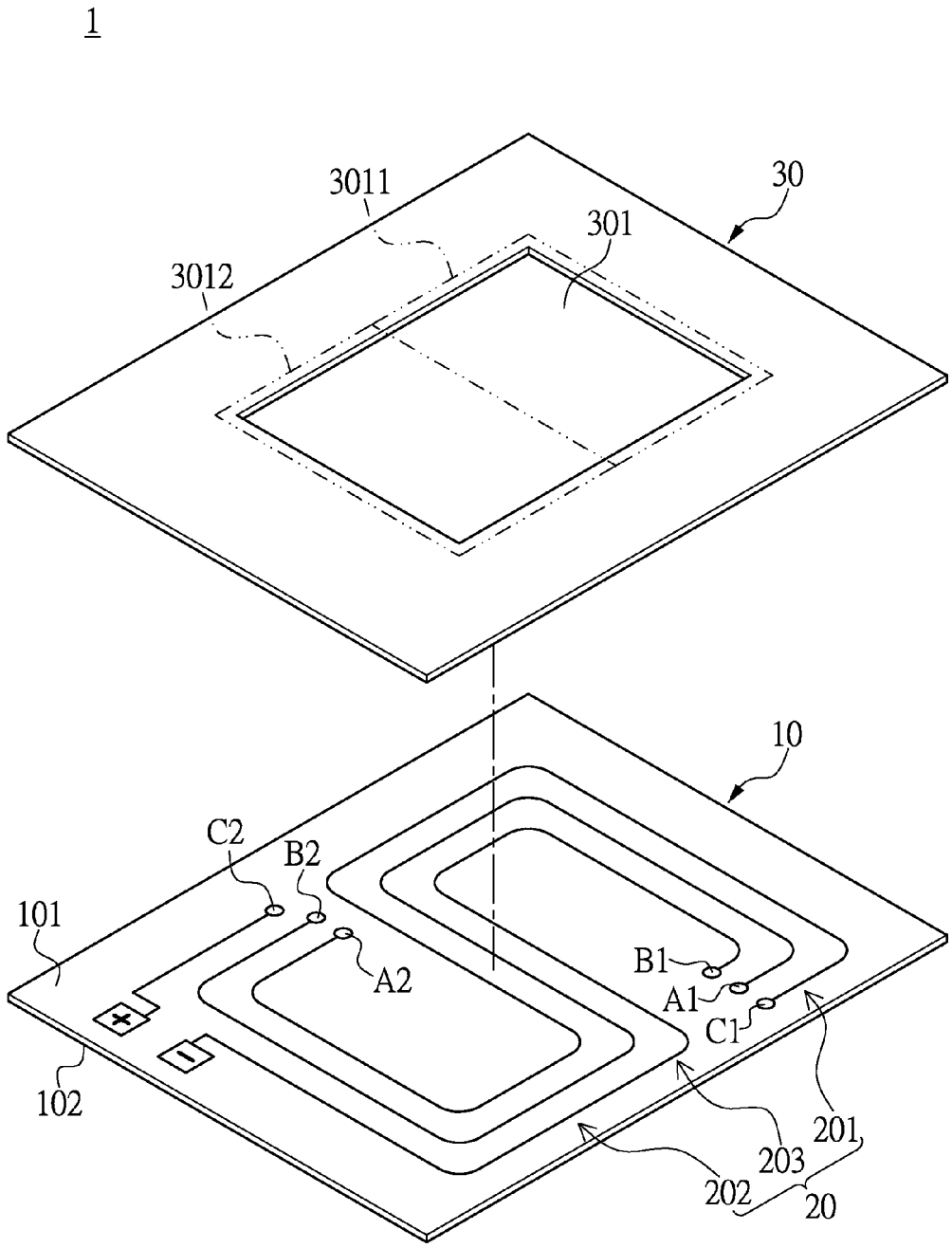
FIG. 2 shows a first schematic diagram of an antenna structure according to the first embodiment of the present disclosure.

FIG. 2 shows a first schematic diagram of an antenna structure according to the first embodiment of the present disclosure. The antenna structure 1 includes: an insulation carrier board 10, a radiation module 20 and a metal board 30. The radiation module 20 is disposed on the insulation carrier board 10. The metal board 30 is disposed on top of the insulation carrier board 10. The radiation module 20 includes: a first coil unit 201, a second coil unit 202 and a connection unit 203. The first coil unit 201 and the second coil unit 202 are coupled. The first coil unit 201 and the second coil unit 202 are disposed on the first surface 101 of the insulation carrier board 10. The connection unit 203 connects the first coil unit 201 and the second coil unit 202. In a preferred embodiment, the second coil unit 202, as shown in the figure, is connected to the positive terminal and the negative terminal of the first surface 101 of the insulation carrier board 10, and through the connection unit 203 (not shown in the figure) of the second surface 102 of the insulation carrier board 10 connects to the first coil unit 201. Likewise, in another embodiment, the first coil unit 201 is connected to the positive terminal and the negative terminal of the first surface 101, and through the connection unit 203 connects to the second coil unit 202. The metal board 30 has an enclosed slot 301. When the metal plate 30 covers the insulation carrier board 10, a portion of the first coil unit 201 and a portion of the second coil unit 202 are exposed at the metal board 30. The insulation carrier board 10 can be made of ceramic materials (such as aluminum, titanium or silicon), ferromagnetic materials (such as iron, cobalt, nickel, copper or alloys thereof), polyvinyl chloride or other similar materials. The insulation carrier board 10 can be formed by sintering ceramic or ferromagnetic materials. It is worth noting that the first coil unit 201 and the second coil unit 202 can each include a matching number of wires. The wires of the first coil unit 201 can be connected at one end to the second coil unit 202 through the connection units (not shown in the figure). The other ends of the first coil unit 201 and the second coil unit 202 can respectively include a matching number of connection points. As shown in the figure, for example the first coil unit 201 can include three connection points A1, B1 and C1, and the second coil unit can correspondingly have three connection points A2, B2 and C2. The connection point A1 of the first coil unit 201 can connect to the connection point A2 of the second coil unit 202 through the second surface 102 of the insulation carrier board 10. Likewise, the connection points B1 and C1 of the first coil unit 201 can be respectively connected to the connection points B2 and C2 of the second coil unit 202.

Figure 3:
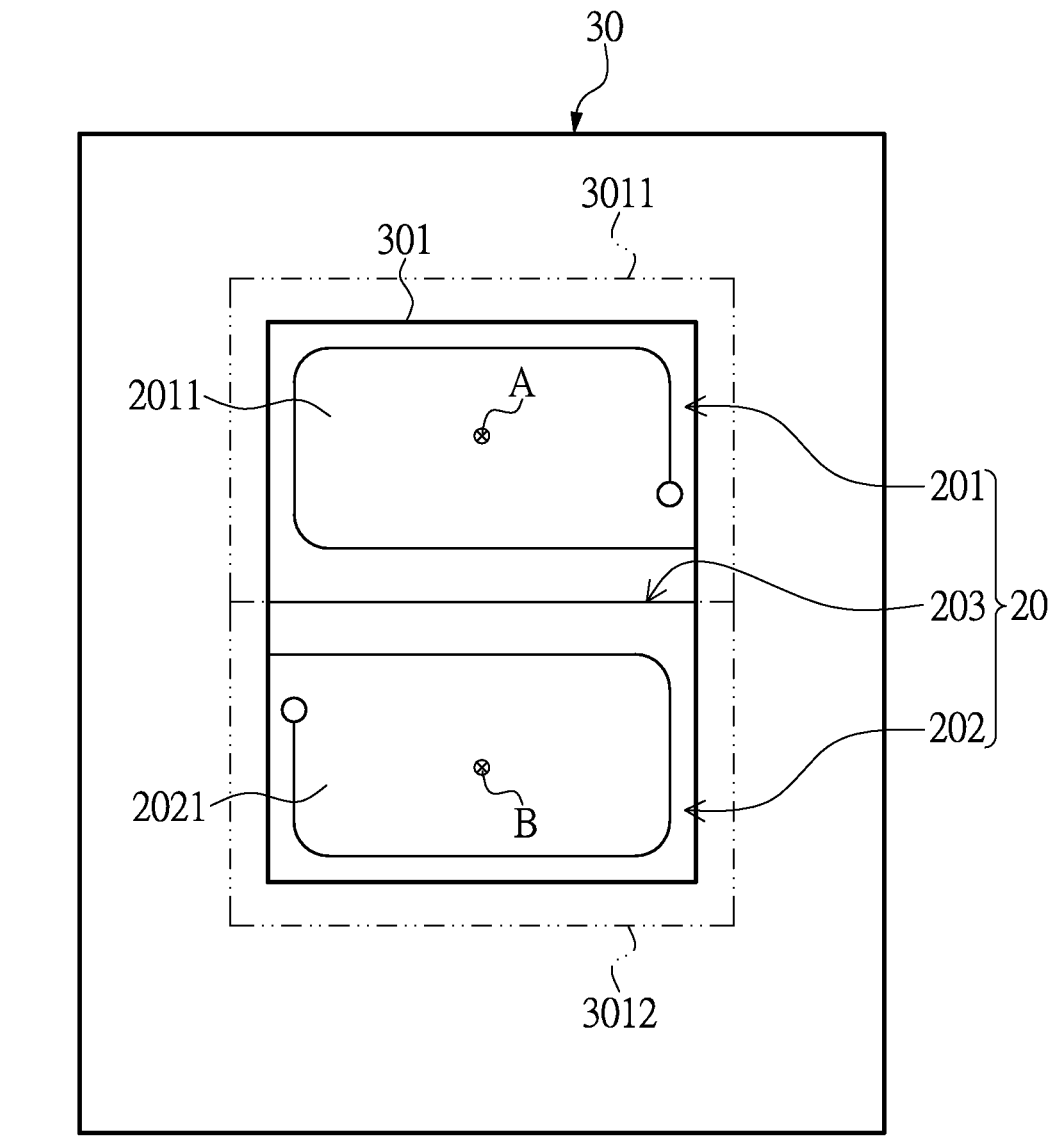
FIG. 3 shows a second schematic diagram of an antenna structure according to the second embodiment of the present disclosure.

Specifically, referring to FIG. 3, the winding center A of the first coil unit 201 has a first coil opening 2011, and the winding center B of the second coil unit 202 has a second coil opening 2021. The enclosed slot 301 of the metal board 30 has a first slot portion 3011 and a second slot portion 3012. The position of the first slot portion 3011 corresponds to the position of the first coil opening 2011, and the position of the second slot portion 3012 corresponds to the position of the second coil opening 2021. When the metal board 30 is disposed on top of the insulation carrier board 10, a portion of the first coil unit 201 and the first coil opening 2011 are exposed at the metal board by the first slot portion 3011. A portion of the second coil unit 202 and the second coil opening 2021 are exposed at the metal board 30 by the second slot portion 3012. It should be emphasized that the winding center A of the first coil unit 201 and the winding center B of the second coil unit 202 must be exposed at the metal board 30. In another embodiment, the metal board 30 can completely shield the first coil unit 201 and the second coil unit 202, and only the connection unit 203, the first coil opening 2011 and the second coil opening 2021 are exposed by the enclosed slot 301. In other words, from a top view, only the wiring of the connection unit 203 can be seen through the enclosed slot 301, and the wiring of the first coil unit 201 and the second coil unit 202 are not visible.

Specifically, the first coil unit 201, the second coil unit 202 and the connection unit 203 of the radiation module 20 can be integrally formed as one body into an S-shaped coil. Namely, the top half of the S-shaped coil is the first coil unit 201, the bottom half of the S-shaped coil is the second coil unit 202, and the middle portion of the S-shaped coil is the connection unit 203.

[Second Embodiment]

Figure 4:
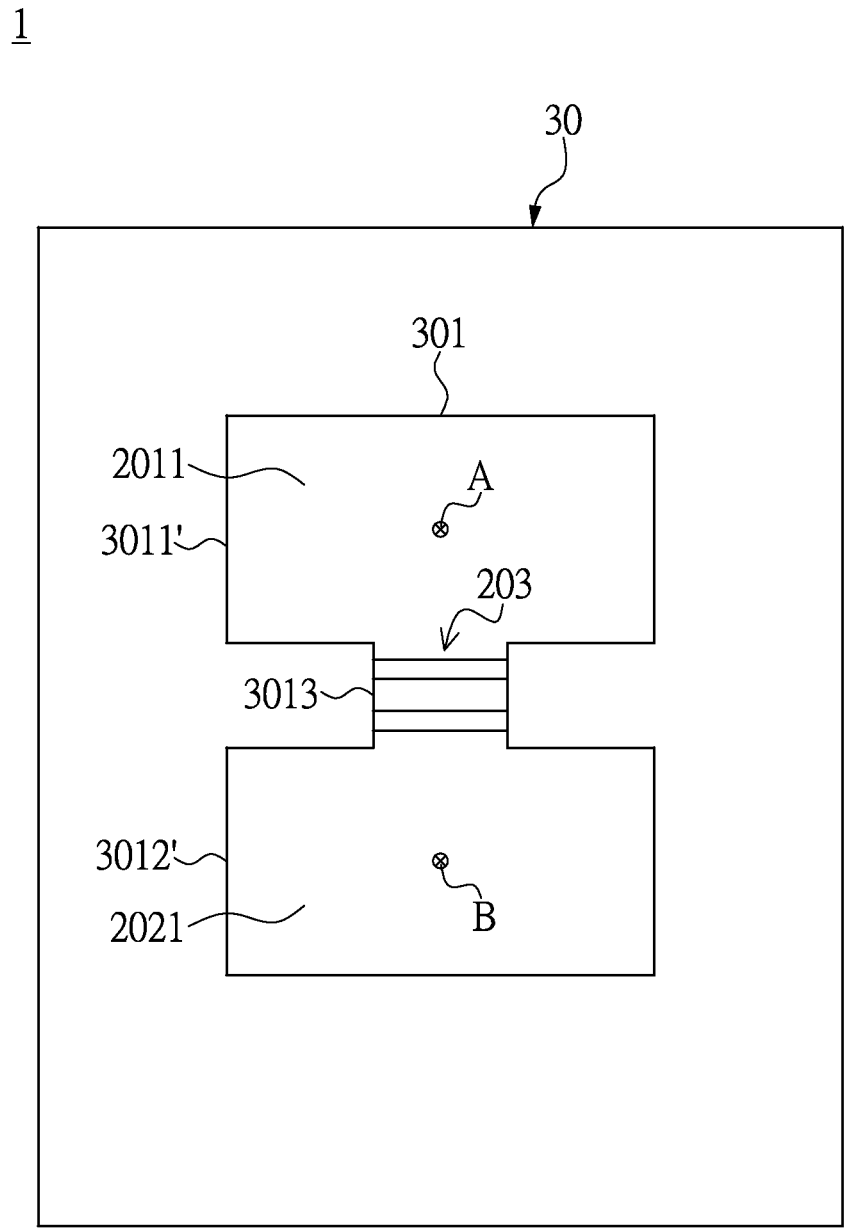
FIG. 4 shows a schematic diagram of an antenna structure according to the second embodiment of the present disclosure.

FIG. 4 shows a schematic diagram of a metal board of an antenna structure according to the second embodiment of the present disclosure. Regarding the relative configuration of and connection between the components of the antenna structure 1, please refer to the previous embodiment. Particular to the present embodiment, the enclosed slot 301 of the metal board 30 can be, besides the single rectangular slot of the first embodiment, formed by a plurality of rectangular slots as shown in FIG. 3. Namely, the first slot portion 3011' and the second slot portion 3012' are connected through a connection portion 3013. Specifically, in the present embodiment, only the first coil opening 2011 can be seen through the first slot portion 3011', and only the second coil opening 2021 can be seen through the second slot portion 3012'. In other words, from a top view, the connection unit 203 can be seen only through the connection portion 3013 of the enclosed slot 301, and no wiring is visible through the other portions. Of course, in another embodiment, the wirings of the first coil unit 201 and the second coil unit 202 can be respectively exposed by the first slot portion 3011' and the second slot portion 3012'.

[Third Embodiment]

Figure 5:
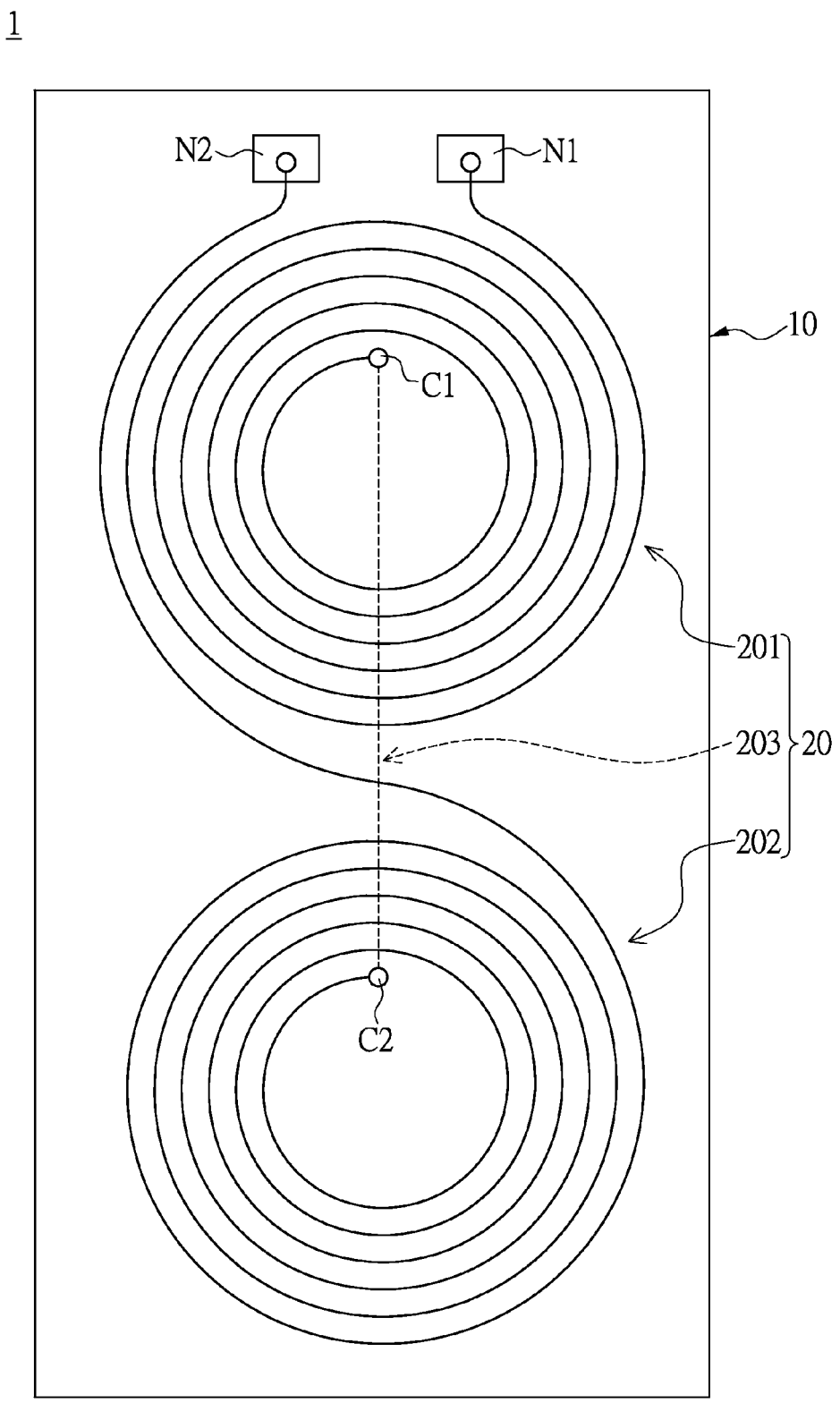
FIG. 5 shows a schematic diagram of an antenna structure according to the third embodiment of the present disclosure.

FIG. 5 shows a schematic diagram of an antenna structure according to the third embodiment of the present disclosure. As mentioned in the above embodiment, the antenna structure 1 includes: an insulation carrier board 10, a radiation module 20 and a metal board 30, the respective connection and configuration of which are similar to those of the previous embodiment. Particular to the present embodiment, the first coil unit 201 and the second coil unit 202 of the radiation module 20 have the form shown in FIG. 5. Specifically, the first surface 101 of the insulation carrier board 10 has a positive terminal N1, a negative terminal N2, a first connection terminal C1 and a second connection terminal C2. The first connection terminal C1 and the second connection terminal C2 are connected through a connection unit 203 on the second surface 102 of the insulation carrier board 10. The two ends of the first coil unit 201 respectively connect to the positive terminal N1 and the first connection terminal C1. The two ends of the second coil unit 202 respectively connect to the negative terminal N1 and the second connection terminal C2. In other words, an end of the first coil unit 201 and an end of the second coil unit 202 respectively connect to the positive terminal N1 and the negative terminal N2. The other end of the first coil unit 201 and the other end of the second coil unit 202 are connected through a connection unit 203 on the on the second surface 102 of the insulation carrier board 10. Of particular note, an end of the first coil unit 201 can be connected to the negative terminal N2 instead of the positive terminal N1, and an end of the second coil unit 202 can correspondingly be connected to the positive terminal N1. The configuration can be changed according to practical needs. The first coil unit 201 and the second coil unit 202 can be planar circular spiraling coils as shown in the figure, or planar multi-lateral spiraling coils. The present disclosure is not limited thereto.

[Fourth Embodiment]

Figure 6:
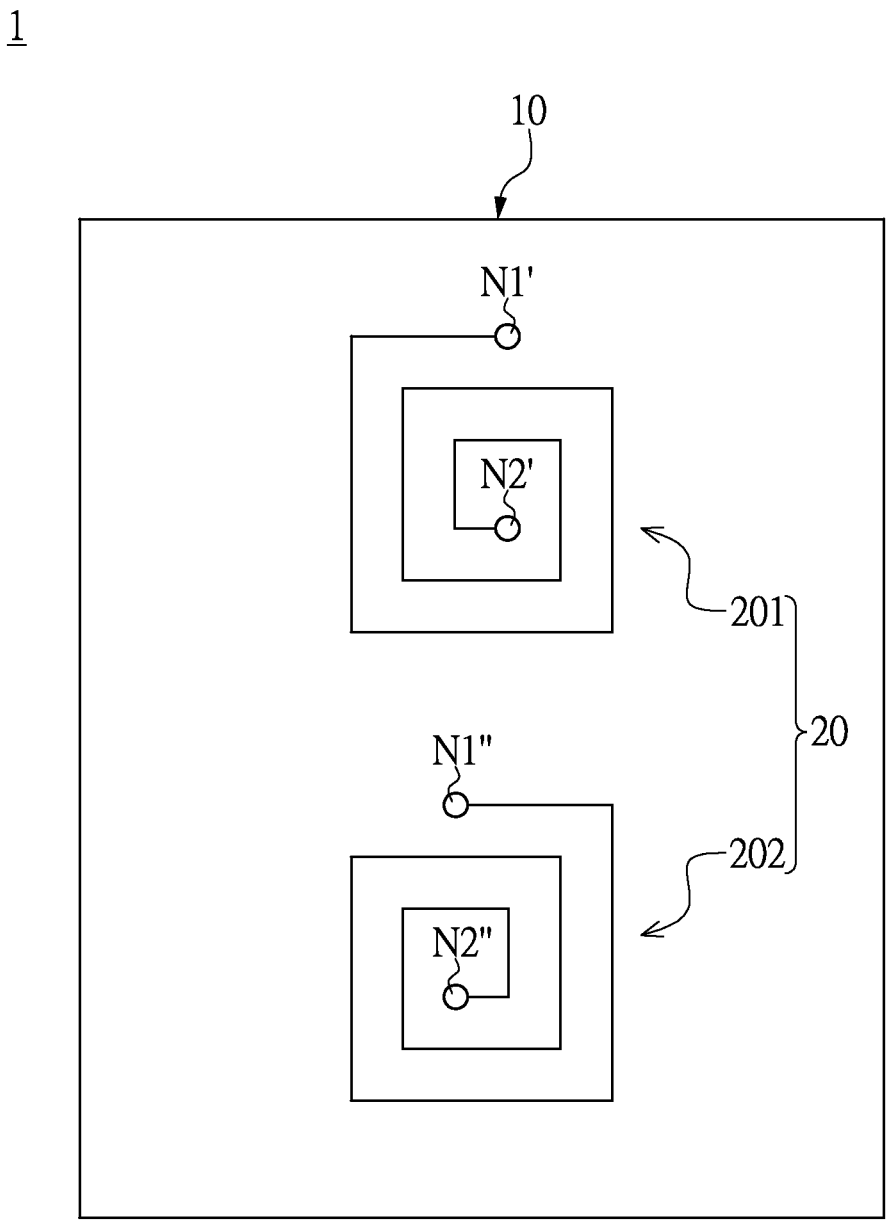
FIG. 6 shows a schematic diagram of an antenna structure according to the fourth embodiment of the present disclosure.

FIG. 6 shows a schematic diagram of an antenna structure according to the fourth embodiment of the present disclosure. As mentioned in the above embodiment, the antenna structure 1 includes: an insulation carrier board 10, a radiation module 20 and a metal board 30, the respective connection and configuration of which are similar to those of the previous embodiment. Particular to the present embodiment, the first coil unit 201 and the second coil unit 202 of the radiation module 20 can be independent antenna radiation bodies coupled to each other. Specifically, the first surface 101 of the insulation carrier board 10 has a first positive terminal N1', a second positive terminal N1", a first negative terminal N2', and a second negative terminal N2". The two ends of the first coil unit 201 are respectively connected to the first positive terminal N1' and the first negative terminal N2'. The two ends of the second coil unit 202 are respectively connected to the second positive terminal N1" and the second negative terminal N2".

[Fifth Embodiment]

Figure 7:
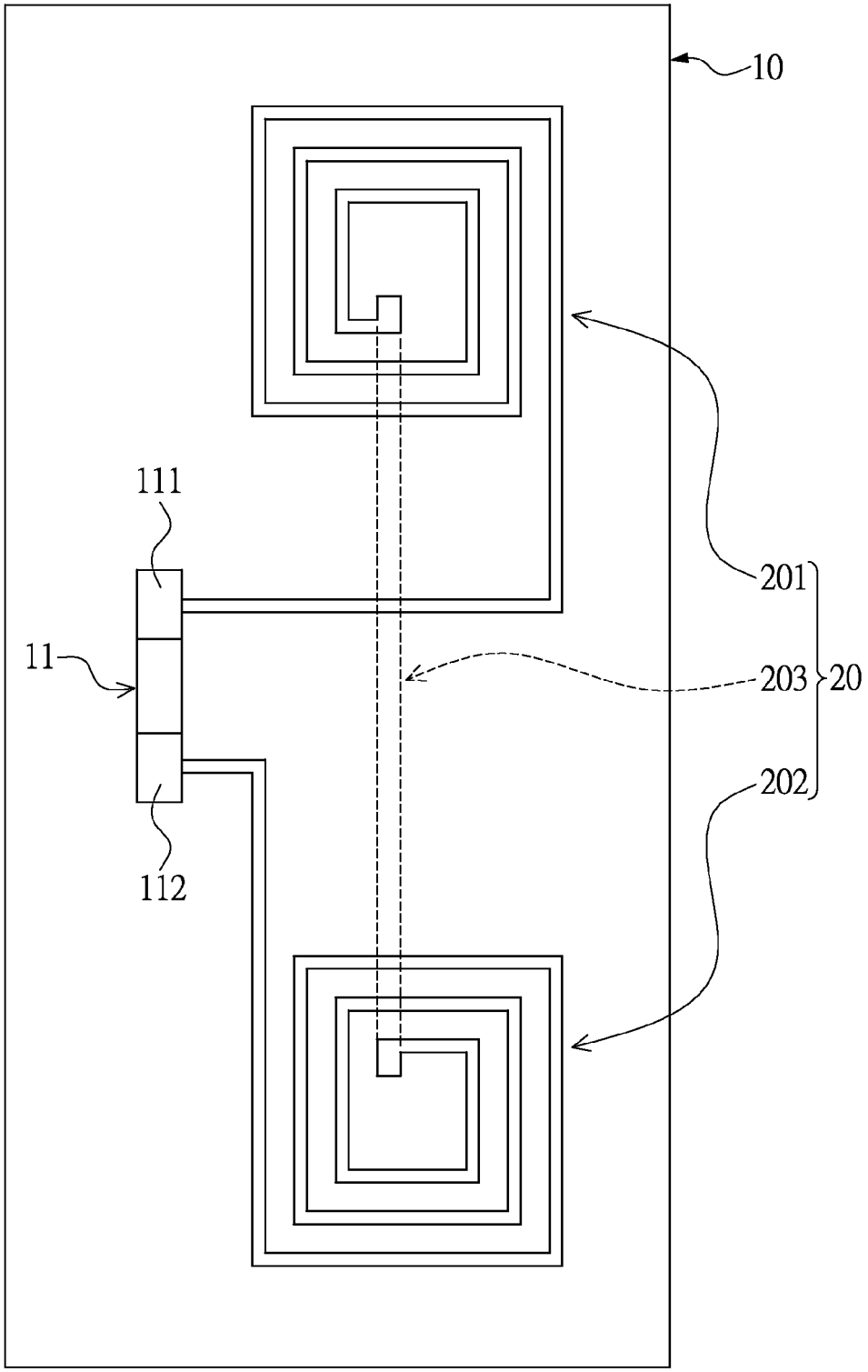
FIG. 7 shows a schematic diagram of an antenna structure according to the fifth embodiment of the present disclosure.

FIG. 7 shows a schematic diagram of an antenna structure according to the fifth embodiment of the present disclosure. The first coil unit 201 and the second coil unit 202 of the radiation module 20 can be connected in series. Specifically, the insulation carrier board 10 can include a feeding portion 11 having a first feeding point 111 and a second feeding point 112. The first coil unit 201 and the second coil u nit 202 are respectively connected at one end to the first feeding point 111 and the second feeding point 112. The other points of the first coil unit 201 and the second coil unit 202 can be connected to the other surface of the insulation carrier board 10 through the connection unit 203, thereby serially connecting the first coil unit 201 and the second coil unit 202 which have electric currents of different directions.

[Sixth Embodiment]

Figure 8:
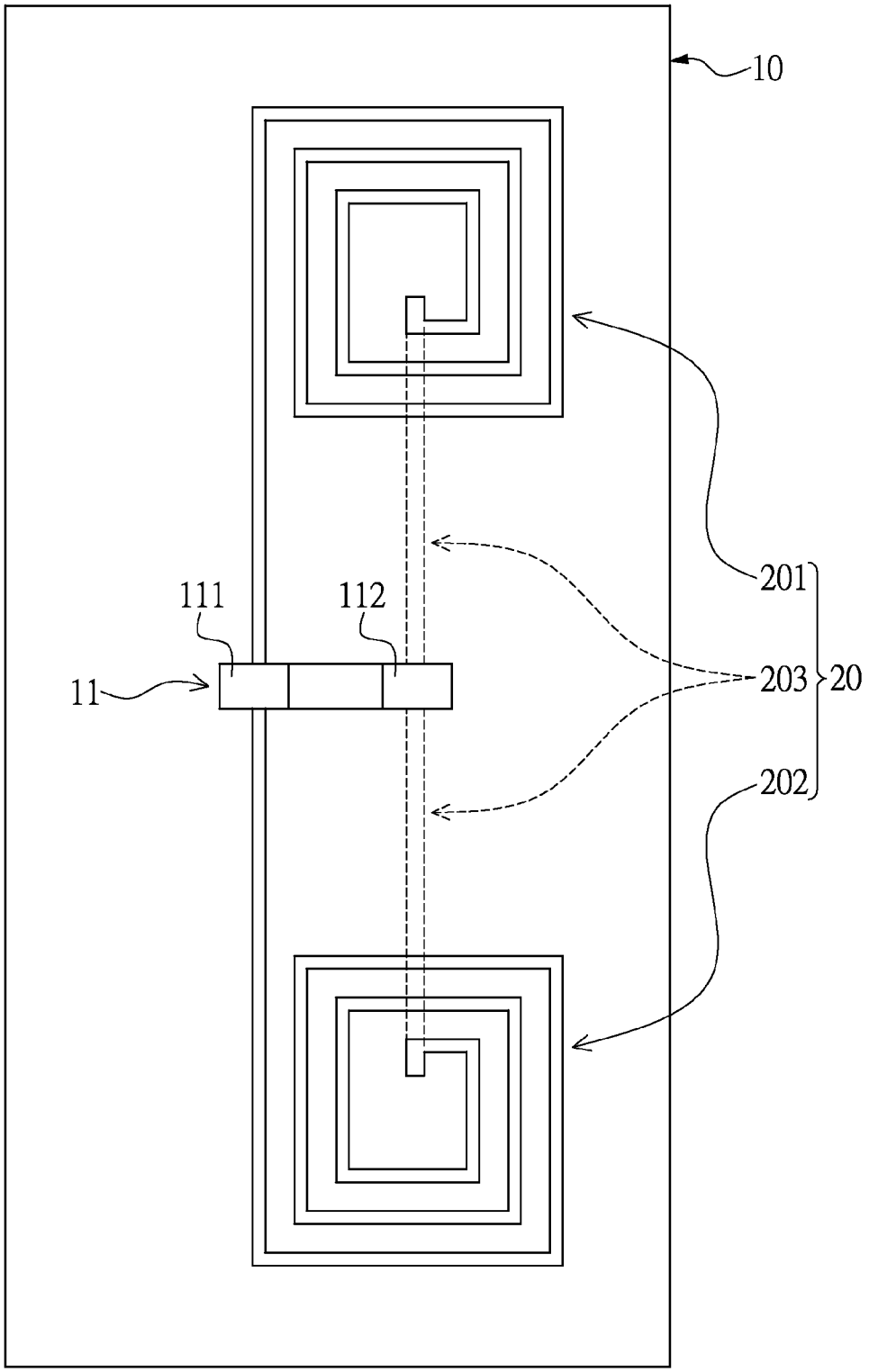
FIG. 8 shows a schematic diagram of an antenna structure according to the sixth embodiment of the present disclosure.

FIG. 8 shows a schematic diagram of an antenna structure according to the sixth embodiment of the present disclosure. The first coil unit 201 and the second coil unit 202 of the radiation module 20 can be connected in parallel. As shown in the figure, the insulation carrier board 10 includes a feeding portion 11 having a first feeding point 111 and a second feeding point 112. The first coil unit 201 and the second coil unit 202 are each connected at one point to the first feeding portion 111 of the feeding portion 11, and the other ends of the first coil unit 201 and the second coil 202 are each connected to the second feeding point 112 of the feeding portion 11 through the connection unit 203 at the second surface 102 of the insulation carrier board 10, thereby connecting in parallel the first coil u nit 201 and the second coil unit 202. In other words, the two ends of the first coil unit 201 are respectively connected to the first feeing point 111 and the second feeding point 112 of the feeding portion 11, and the two ends of the second coil unit 202 are respectively connected to the first feeding point 111 and the second feeding point 112.

[Seventh Embodiment]

Figure 9:
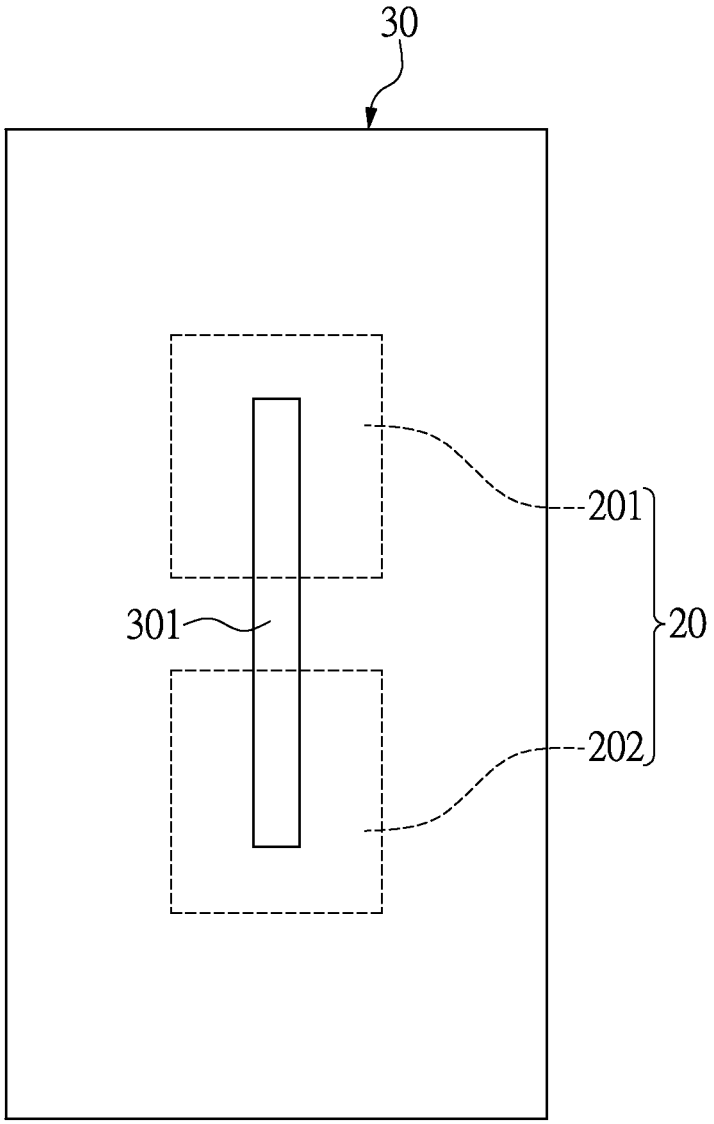
FIG. 9 shows a first schematic diagram of an antenna structure according to the seventh embodiment of the present disclosure.
Figure 10:
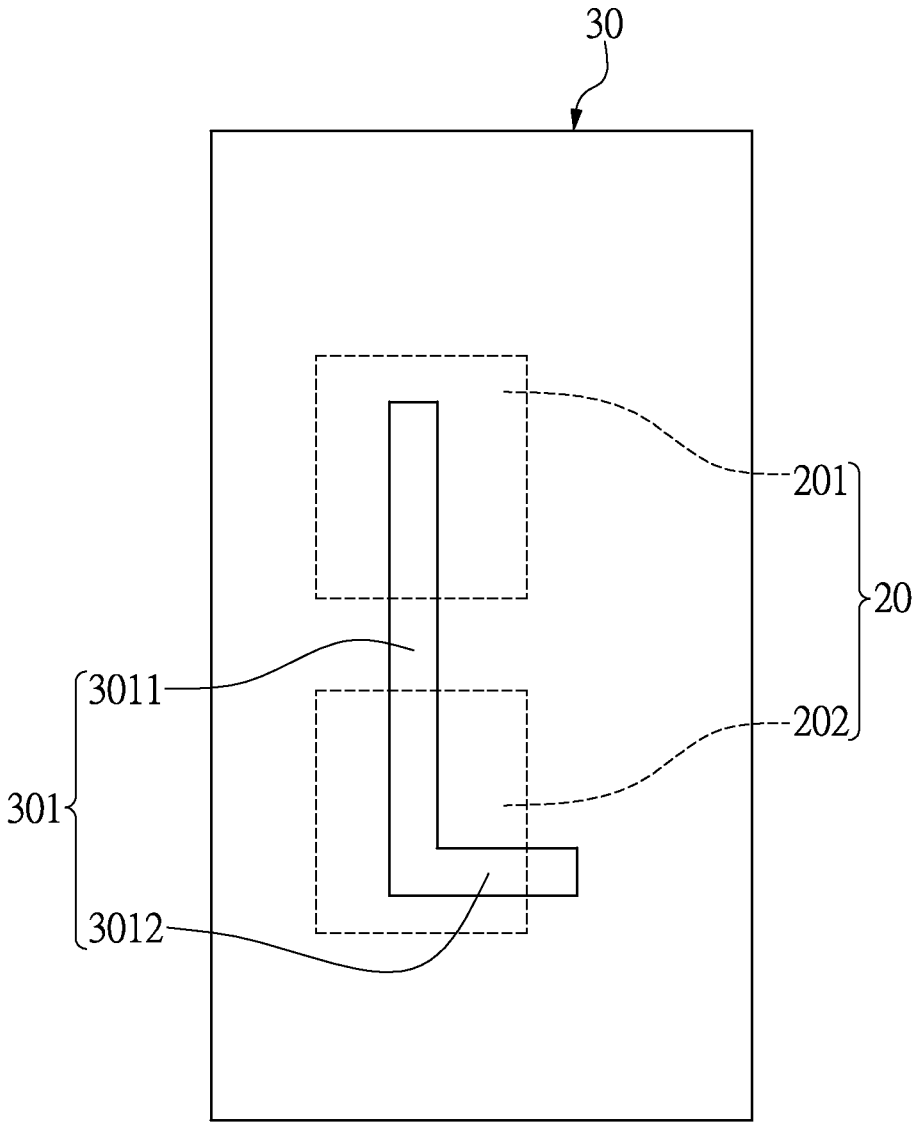
FIG. 10 shows a second schematic diagram of an antenna structure according to the seventh embodiment of the present disclosure.
Figure 11:
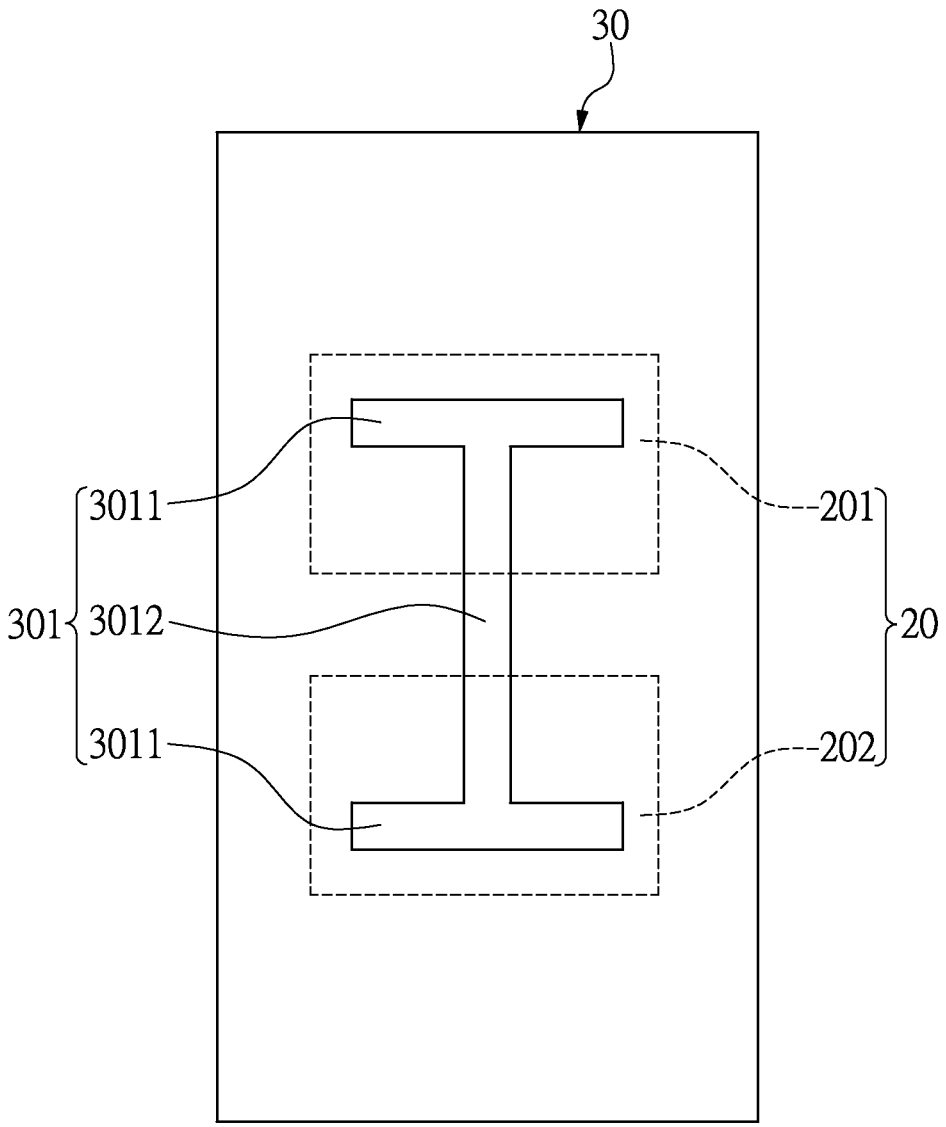
FIG. 11 shows a third schematic diagram of an antenna structure according to the seventh embodiment of the present disclosure.

FIG. 9 to FIG. 11 show shows schematic diagrams of an antenna structure according to the seventh embodiment of the present disclosure. When the metal board 30 is disposed on the first coil unit 201 and the second coil u nit 202, the enclosed slot 301 of the metal board 30 can be of any shape as long as it exposes portions of the first coil opening (not shown in the figure) of the first coil unit 201 and the second coil opening (not shown in the figure) of the second coil unit 202. For example, the enclosed slot 301 of the metal board 30 can be a letter from the English alphabet, such as a lower case "I" as shown in FIG. 9, an "L" composed of a longitudinal first slot portion 3011 and a horizontal second slot portion 3012 as shown in FIG. 10, or an upper case "I" composed of two horizontal first slot portions 3011 and a vertical second slot portion 3012 as shown in FIG. 11. The above serve only as examples. The enclosed slot 301 can be any letter of the English alphabet and is not limited to the letters shown in the figures.

[Eight Embodiment]

Figure 12:
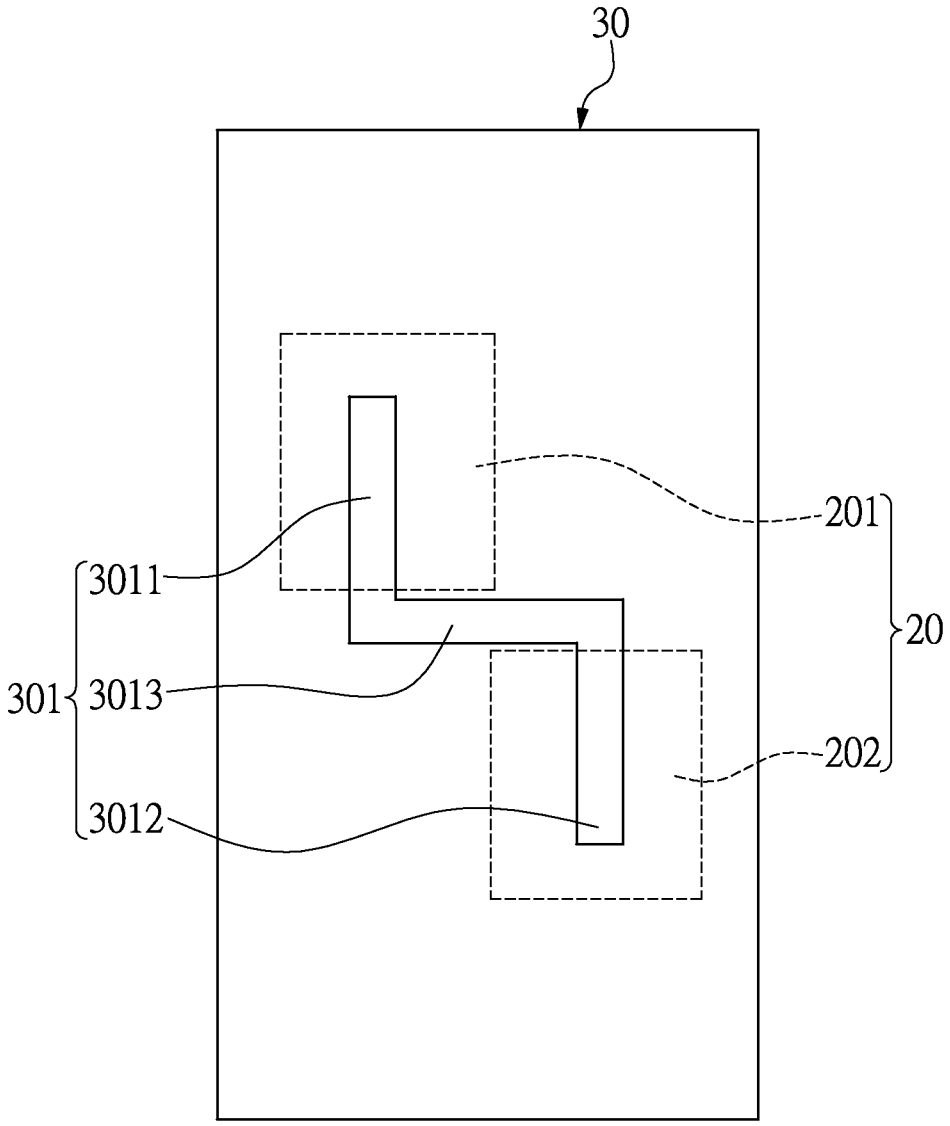
FIG. 12 shows a schematic diagram of an antenna structure according to the eighth embodiment of the present disclosure.

FIG. 12 shows a schematic diagram of an antenna structure according to the eighth embodiment of the present disclosure. As shown in the figure, the first coil unit 201 and the second coil unit 202 can be offset from each other. The enclosed slot 301 of the metal board 30 can include a first slot portion 3011 for exposing a portion of the first coil opening (not shown in the figure) of the first coil unit 201, a second slot portion 3012 for exposing a portion of the second coil opening (not shown in the figure) of the second coil unit 202, and a connection portion 3013 connecting the first slot portion 3011 and the second slot portion 3012. The shape of the first slot portion 3011, the second slot portion 3012 and the connection portion 3013 can be altered according to need and is not limited to the forms shown in the figures.

[Ninth Embodiment]

Figure 13:
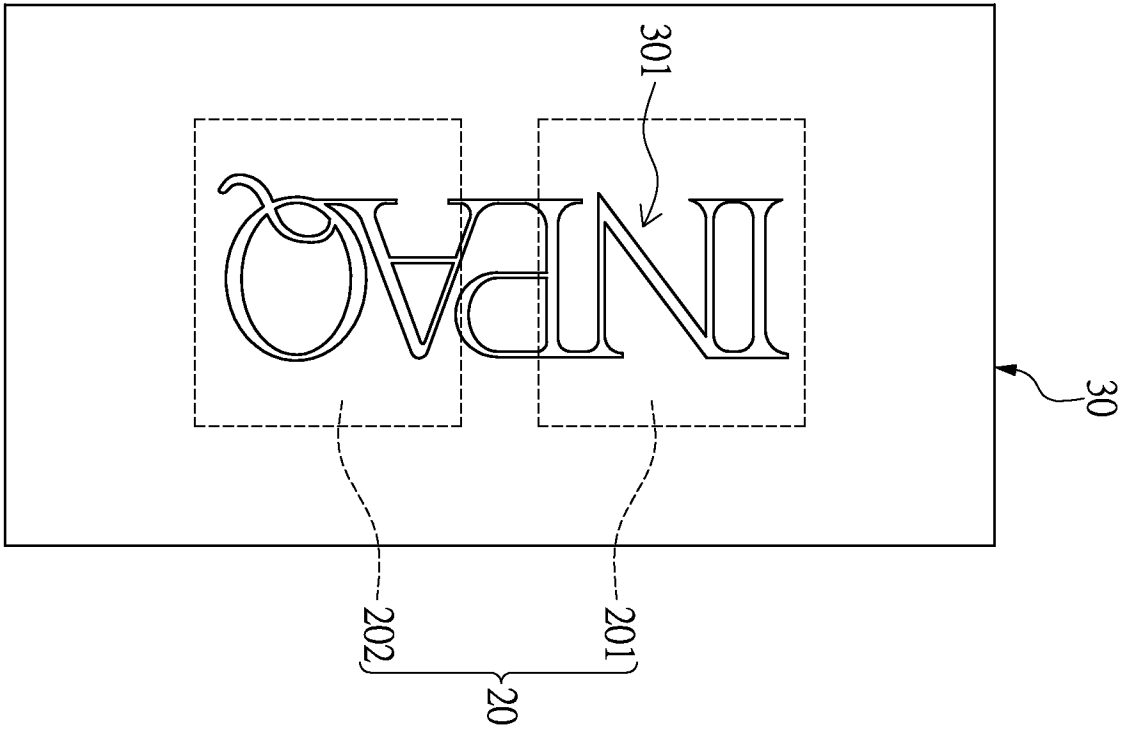
FIG. 13 shows a first schematic diagram of an antenna structure according to the ninth embodiment of the present disclosure.
Figure 14:
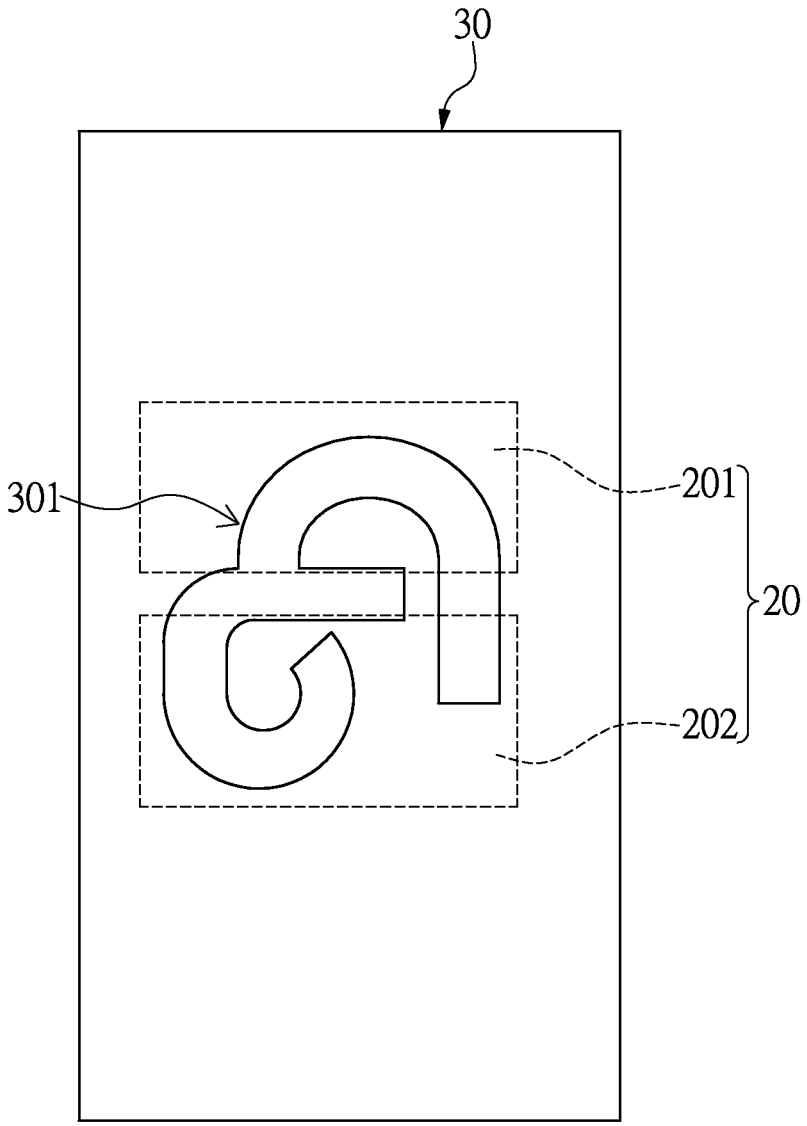
FIG. 14 shows a second schematic diagram of an antenna structure according to the ninth embodiment of the present disclosure.

FIG. 13 and FIG. 14 show schematic diagrams of an antenna structure according to the ninth embodiment of the present disclosure. As shown in the figures, in other applications, the enclose slot 301 of the metal board 30 can include a plurality of connected letters of the English alphabet, or any connected patterns or designs, as long as portions of the first coil opening (not shown in the figure) of the first coil unit 201 and the second coil opening (not shown in the figure) of the second coil unit 202 are exposed.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. An antenna structure, comprising:

a radiation module, having a first coil unit and a second coil unit coupled to each other, wherein the direction of the electric current of the first coil unit and the direction of the electric current of the second coil unit are opposite;

a metal board, disposed at one side of the radiation module, and having an enclosed slot, wherein the enclosed slot has a first slot portion and a second slot portion interconnected to the first slot portion; and an insulation carrier board having a first surface and a second surface opposite each other, wherein the first coil unit and the second coil unit are disposed on the first surface of the insulation carrier board;

wherein the radiation module includes a connection unit disposed on the second surface of the insulation carrier board, and the connection unit has two ends respectively connected to the first coil unit and the second coil unit;

wherein the first slot portion and the second slot portion of the metal board correspond respectively to the position of the first coil unit and the position of the second coil unit;

wherein the winding center of the first coil unit has a first coil opening, and the winding center of the second coil unit has a second coil opening, the first slot portion of the metal board exposes at least a portion of the first coil opening at the metal board, and the second slot portion of the metal board exposes at least a portion of the second slot opening at the metal board;

wherein an end of the first coil unit is connected to a positive terminal on the first surface of the insulation carrier board, an end of the second coil unit is connected to a negative terminal on the first surface of the insulation carrier board, the other end of the first coil unit and the other end of the second coil unit are connected to each other through the connection unit on the second surface of the insulation carrier board;

wherein when the metal board is disposed on top of the first surface of insulation carrier board, the metal board shields the first coil unit and the second coil unit, and the connection unit is exposed at the metal board through the enclosed slot of the metal board.

2. The antenna structure according to claim 1, wherein the direction of the electric current of the first coil unit is clockwise, and the direction of the electric current of the second coil unit is counter-clockwise.

3. The antenna structure according to claim 1, wherein the direction of the electric current of the first coil unit is counter-clockwise, and the direction of the electric current of the second coil unit is clockwise.

4. The antenna structure according to claim 1, wherein the first coil unit and the second coil unit are shielded by the metal board.

5. The antenna structure according to claim 1, wherein the first coil unit and the second coil unit of the radiation module are connected through the connection unit, forming an integral S-shaped structure.

6. The antenna structure according to claim 1, wherein the first coil unit and the second coil unit are planar multi-lateral spiraling coils or planar circular spiraling coils.

7. The antenna structure according to claim 1, wherein only one of the first coil unit and the second coil unit has a positive terminal and a negative terminal.

8. The antenna structure according to claim 1, wherein the first coil unit and the second coil unit are connected in series or in parallel.

* * * * *